US012523407B1

(12) United States Patent
Wu et al.

(10) Patent No.: US 12,523,407 B1
(45) Date of Patent: Jan. 13, 2026

(54) ICE BUCKET STRUCTURE

(71) Applicant: ZHEJIANG DINGSHENG OUTDOOR LIVING PRODUCTS CO., LTD., Taizhou (CN)

(72) Inventors: Jing Wu, Taizhou (CN); Huanchao Chen, Taizhou (CN); Junhui Zheng, Taizhou (CN)

( * ) Notice: Subject to any disclaimer, the term of this patent is extended or adjusted under 35 U.S.C. 154(b) by 0 days.

(21) Appl. No.: 19/299,893

(22) Filed: Aug. 14, 2025

(30) Foreign Application Priority Data

Aug. 1, 2025 (CN) ..... 202521628913.8

(51) Int. Cl.
*F25D 3/06* (2006.01)
*A45B 23/00* (2006.01)
*F25D 11/00* (2006.01)

(52) U.S. Cl.
CPC ..... *F25D 3/06* (2013.01); *F25D 11/003* (2013.01); *A45B 2023/0012* (2013.01); *A45B 2200/1027* (2013.01); *A45B 2200/1054* (2013.01); *F25D 2303/08* (2013.01); *F25D 2321/142* (2013.01); *F25D 2331/802* (2013.01)

(58) Field of Classification Search
CPC ..... F25D 3/06; F25D 3/08; F25D 2303/08; F25D 2303/081; F25D 2303/08221; F25D 2321/142; F25D 2321/802; F25D 31/002; F25D 31/006; F25D 31/007; F25D 31/008; F25D 3/02; F25D 3/04; F25D 3/045; A45B 2023/0012; A45B 25/00; A45B 25/28; A45B 2200/10; A45B 2200/1009; A45B 2200/1027; A45B 2200/1036; A45B 2200/1045; A45B 2200/1054
See application file for complete search history.

(56) References Cited

U.S. PATENT DOCUMENTS 5,979,793 A * 11/1999 Louis ..... F24F 5/0035 239/289
7,393,116 B1 * 7/2008 Holmes ..... F21S 2/00 362/253
8,733,254 B1 * 5/2014 Wakefield ..... A47B 37/04 108/50.11
2013/0153737 A1 * 6/2013 Zoeteman ..... E04H 12/2238 248/513

* cited by examiner

*Primary Examiner* — Miguel A Diaz

(57) ABSTRACT

An ice bucket structure includes an ice bucket body and a bucket cover matching with each other. An ice storage cavity is provided in the ice bucket body, an inner container is provided in the ice bucket body, a load-bearing cavity is provided in the inner container, and a foot tube for insertion and fixation of a sunshade is vertically provided in the ice bucket body.

10 Claims, 8 Drawing Sheets

ICE BUCKET STRUCTURE

CROSS-REFERENCE TO RELATED APPLICATIONS

This application claims priority to Chinese Patent Application No. 202521628913.8, filed on Aug. 1, 2025, the entire disclosure of which is incorporated herein by reference.

TECHNICAL FIELD

The present application relates to the technical field of ice bucket manufacturing, in particular to an ice bucket structure.

BACKGROUND

With the transformation of people's lifestyles and concepts, outdoor activities are increasingly favored by people, and camping has become a popular leisure activity for people (especially young people). During outdoor activities, people use ice buckets to conveniently preserve iced drinks.

An ice bucket is a barrel-shaped storage container that can store ice cubes inside to chill beverages, beers, and other drinks. However, existing ice bucket products have a single function, so the structure of ice buckets needs further improvement.

SUMMARY

The purpose of the present application is to make up for the above deficiencies and publicly disclose an ice bucket structure which is simple and reasonable in structure and can be used for fixing a sunshade.

The technical solution of the present application is realized as follows:

An ice bucket structure includes an ice bucket body and a bucket cover matching with each other; the ice bucket body being provided with an ice storage cavity;

wherein an inner container is provided in the ice bucket body, a load-bearing cavity is provided in the inner container, and a foot tube for insertion and fixation of a sunshade is vertically provided in the ice bucket body.

In one embodiment, the foot tube passes through the inner container, and a bottom of the foot tube is fixed to a bottom of the ice bucket body by a fixing screw.

In one embodiment, the bottom of the ice bucket body is integrally formed with studs, the bottom of the foot tube is provided with a fixing plate, and the fixing plate is provided with fixing holes corresponding to a number of the studs; and the foot tube is inserted from the bottom of the ice bucket body and passes through the inner container, and the studs pass through corresponding fixing holes and are fixed with nuts.

In one embodiment, the bottom of the foot tube is provided with a base, the foot tube is inserted from the bottom of the ice bucket body and passes through the inner container, and the ice bucket body is placed on the base.

In one embodiment, a gap is formed between an outer wall of the inner container and an inner wall of the ice bucket body, and the bottom of the ice bucket body is provided with a water leakage hole.

In one embodiment, a bushing is provided in the foot tube, and a handwheel bolt is radially provided on the foot tube.

In one embodiment, the inner container is provided with an inner container cover that is movable up and down along the foot tube.

In one embodiment, a waterproof decorative lamp is provided in the ice bucket body.

In one embodiment, a refrigerator is provided in the ice bucket body, and the refrigerator is detachably connected to a solar module through a direct current (DC) connector.

In one embodiment, a water suction pipe that is extendable into the ice storage cavity is provided in an umbrella pole of the sunshade, a filter is provided at a lower end of the water suction pipe, an upper end of the water suction pipe is connected to a water suction pump, a water outlet pipe is connected to a water suction pump, and a nozzle is provided at an outlet of the water outlet pipe.

Compared with the related art, the present application has the following advantages:

The ice bucket structure of the present application is simple and reasonable in structure. It is provided with an ice storage cavity and a foot tube for insertion and fixation of a sunshade in the ice bucket body. In addition to maintaining the function of the ice bucket, the foot tube can be used to assemble a sunshade, so that the ice bucket can be used as the base of the sunshade. The ice bucket body is also provided with an inner container. By injecting a counterweight (usually water or sand) into the load-bearing cavity of the inner container, the stability of the sunshade support is ensured.

DETAILED DESCRIPTION OF THE EMBODIMENTS

Figure 1:
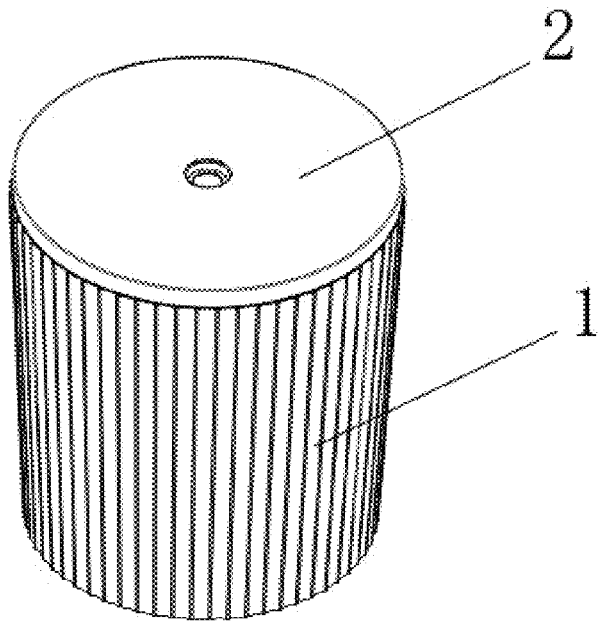
FIG. 1 is a view of the three-dimensional structure of Embodiment 1 of the present application.

The present application will be described in further detail below with reference to the accompanying drawings:

The following description is intended to disclose the present application so that those skilled in the art can implement it. The preferred embodiments in the following description are merely examples, and those skilled in the art can conceive of other obvious variations. The basic principles of the present application defined in the following description can be applied to other implementations, modifications, improvements, equivalents, and other technical solutions that do not depart from the spirit and scope of the present application.

It should be understood by those skilled in the art that in the disclosure of the present application, terms such as "longitudinal", "transverse", "upper", "lower", "left", "right", "front", "rear", "vertical", "horizontal", "top", "bottom", "inner", "outer" indicate orientations or positional relationships based on the orientations or positional relationships shown in the drawings. These terms are only for the convenience of simplifying the description of the present application, and do not indicate or imply that the referred device or element must have a specific orientation, be constructed and operated in a specific orientation. Therefore, the above terms should not be construed as limiting the present application.

It can be understood that the term "a" should be understood as "at least one" or "one or more". That is, in one embodiment, the number of an element can be one, while in another embodiment, the number of the element can be multiple. The term "a" should not be understood as a limitation on quantity.

Embodiment 1

Figure 2:
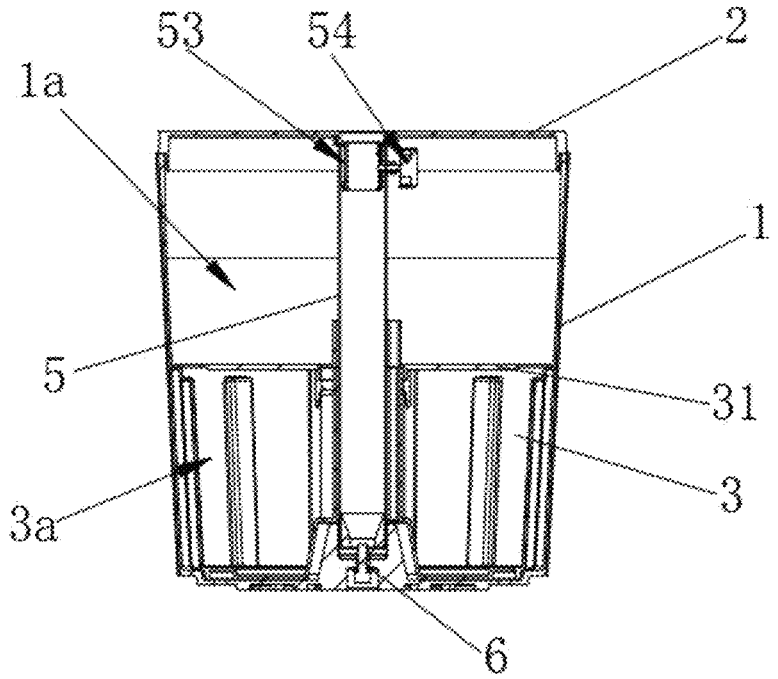
FIG. 2 is a cross-sectional view of Embodiment 1 of the present application.
Figure 3:
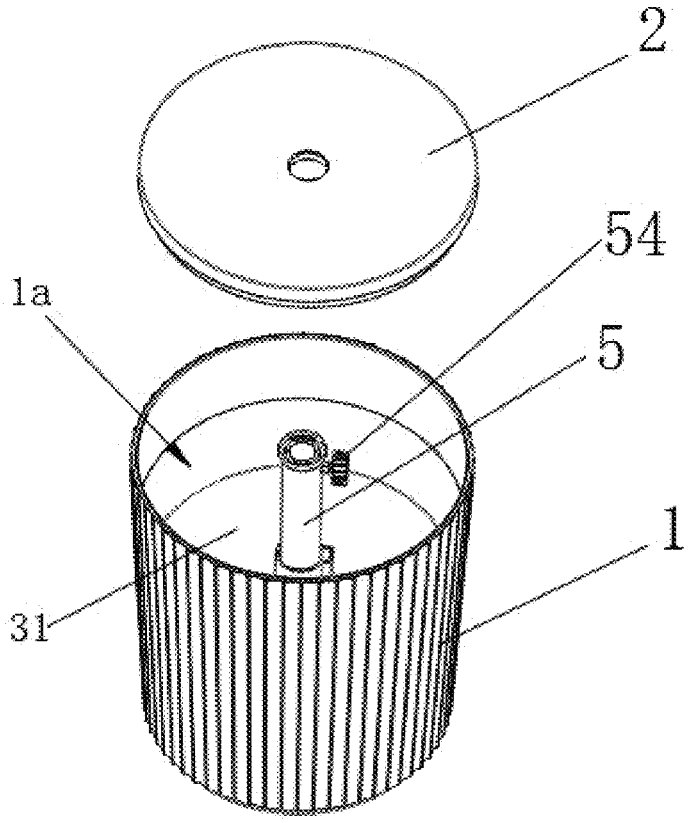
FIG. 3 is a view of the three-dimensional structure of Embodiment 2 of the present application.
Figure 4:
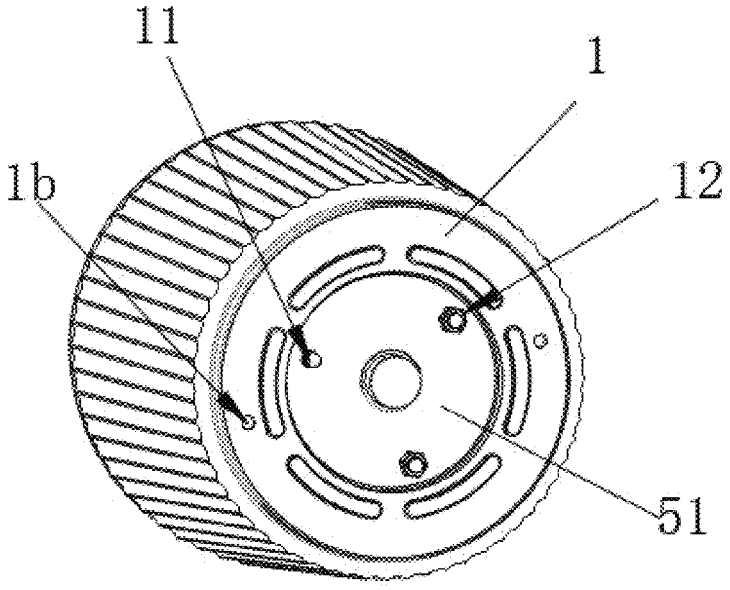
FIG. 4 is a view of the three-dimensional structure of Embodiment 2 of the present application from another perspective.
Figure 5:
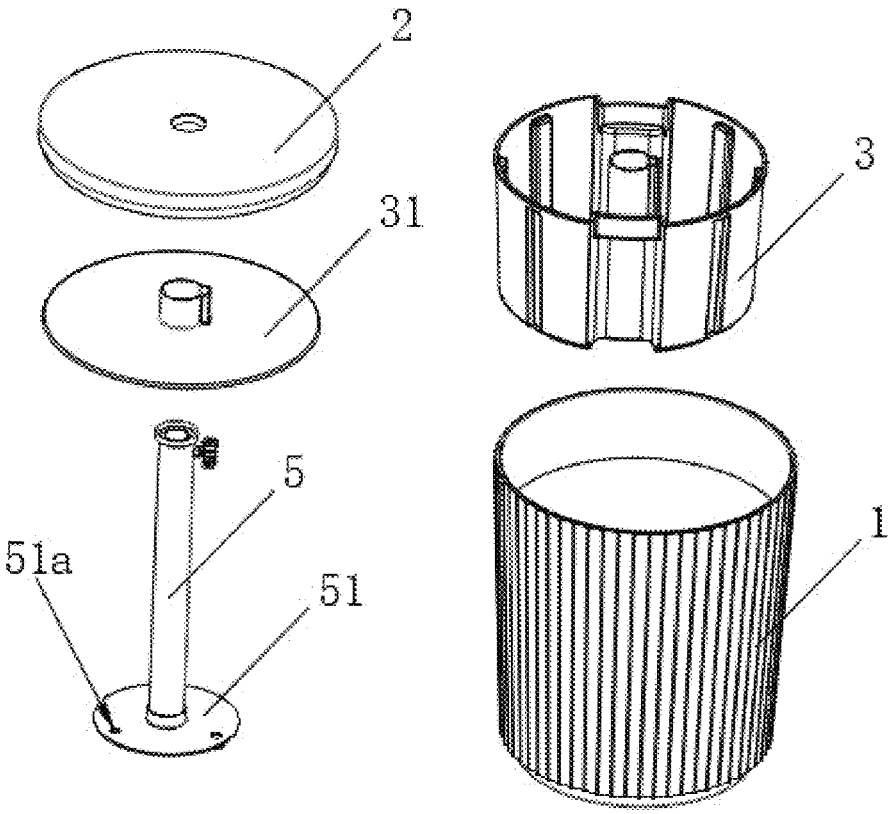
FIG. 5 is an exploded view of Embodiment 2 of the present application.
Figure 6:
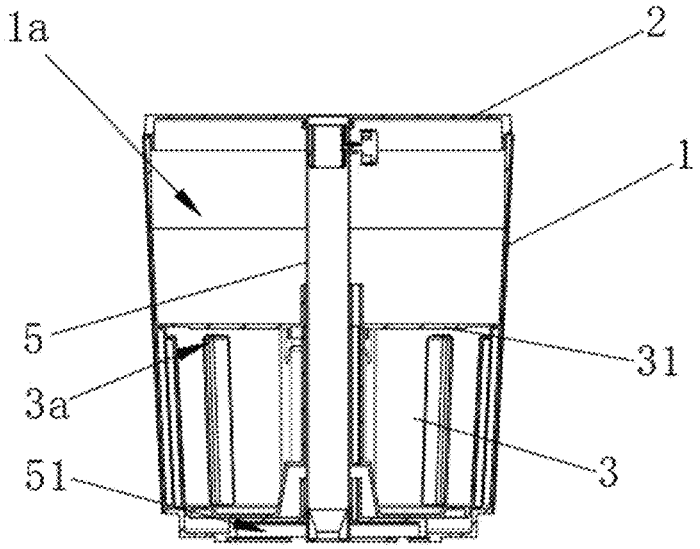
FIG. 6 is a cross-sectional view of Embodiment 2 of the present application.

As shown in FIGS. 1 to 2, an ice bucket structure includes an ice bucket body 1 and a bucket cover 2 machining with each other. The ice bucket body 1 is provided with an ice storage cavity 1*a*, and an inner container 3 is provided in the ice bucket body 1. The inner container 3 is provided with an inner container cover 31 that can move up and down along a foot tube 5. A load-bearing cavity 3*a* is provided in the inner container 3, and the foot tube 5 for insertion and fixation of a sunshade 4 is vertically provided in the ice bucket body 1.

The inner container 3 is detachably matched with the ice bucket body 1. After the inner container 3 is assembled, a gap is formed between an outer wall of the inner container 3 and an inner wall of the ice bucket body 1, and a water leakage hole 1*b* is provided at a bottom of the ice bucket body 1. When the ice bucket is in use, the water from melted ice in the ice storage cavity 1*a* can flow out from the water leakage hole 1*b*.

The foot tube 5 passes through the inner container 3, and a bottom of the foot tube 5 is fixed to the bottom of the ice bucket body 1 by a fixing screw 6.

Further, a bushing 53 is provided in the foot tube 5, and a handwheel bolt 54 is radially provided on the foot tube 5. The handwheel bolt 54 can be used to fix an umbrella pole of the sunshade 4.

The ice bucket structure of the present application not only has the function of an ordinary ice bucket but also can be used as a base for the sunshade 4. When used as a base, a counterweight (usually water or sand) is injected into the load-bearing cavity 3*a*. When injecting the counterweight, the handwheel bolt 54 is removed, and then the inner container cover 31 is moved upward along the foot tube 5 to open the load-bearing cavity 3*a*. After the counterweight is injected, the inner container cover 31 is closed. Then, the umbrella pole of the sunshade 4 is inserted into the foot tube 5, and the handwheel bolt 54 is tightened for fixing. The counterweight in the load-bearing cavity 3*a* is used for weighting to ensure the stability of the sunshade 4. The inner container cover 31 isolates the load-bearing cavity 3*a* from the ice storage cavity 1*a*, and ice cubes are placed in the ice storage cavity 1*a* to realize the function of the ice bucket.

Embodiment 2

As shown in FIGS. 3 to 6, the ice bucket structure of this embodiment is similar to that of Embodiment 1, except that in this embodiment, the bottom of the ice bucket body 1 is integrally formed with studs 11, the bottom of the foot tube 5 is provided with a fixing plate 51, and the fixing plate 51 is provided with fixing holes 51*a* corresponding to a number of the studs 11. The foot tube 5 is inserted from the bottom of the ice bucket body 1 and passes through the inner container 3, and the studs 11 pass through the fixing holes 51*a* and are fixed with nuts 12.

In this embodiment, the fixing structure between the foot tube 5 and the ice bucket body 1 has good reliability and can prevent the foot tube 5 from rotating relative to the ice bucket body 1 and causing loosening.

Embodiment 3

Figure 7:
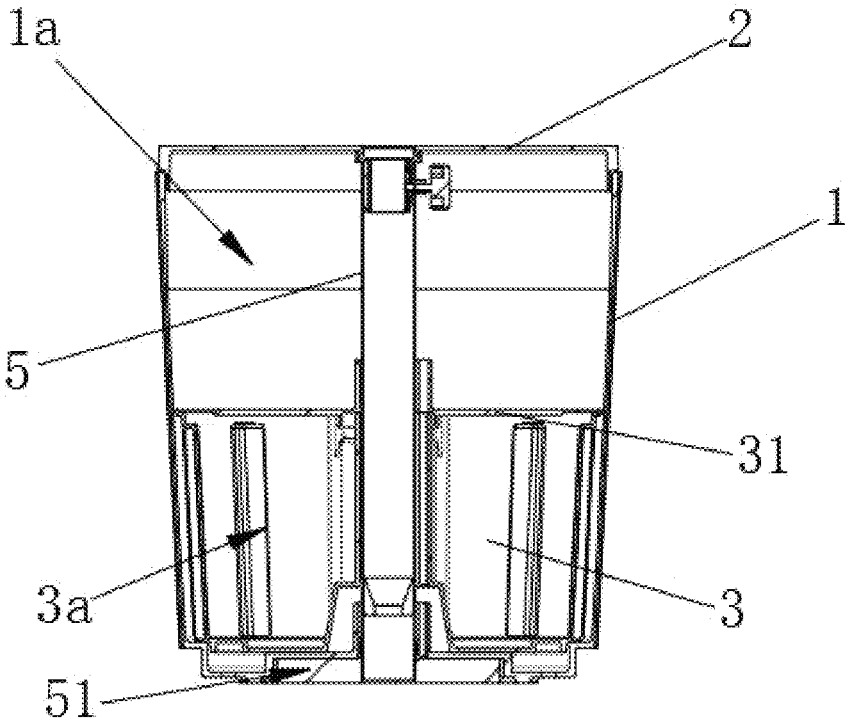
FIG. 7 is a cross-sectional view of Embodiment 3 of the present application.
Figure 8:
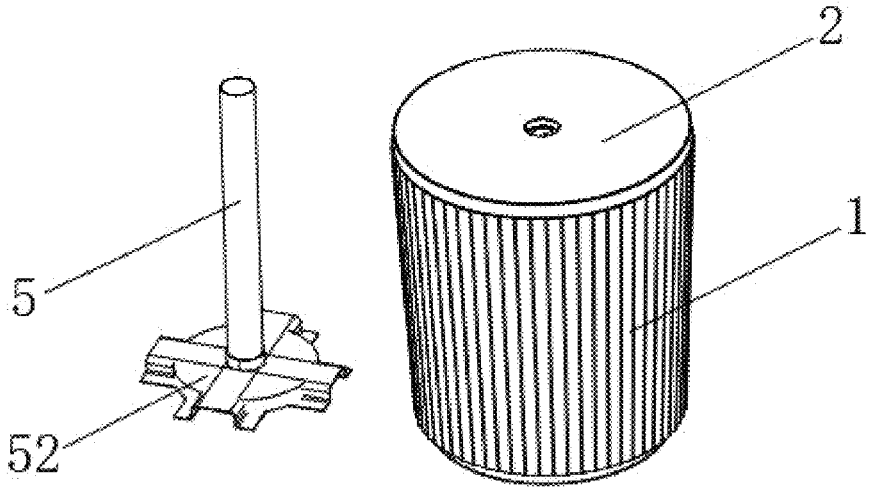
FIG. 8 is an exploded view of Embodiment 3 of the present application.

As shown in FIGS. 7 to 8, the ice bucket structure of this embodiment is similar to that of Embodiment 1, except that in this embodiment, the bottom of the foot tube 5 is provided with a base 52, the foot tube 5 is inserted from the bottom of the ice bucket body 1 and passes through the inner container 3, and the ice bucket body 1 is pressed and placed on the base 52.

In this embodiment, the foot tube 5 is fixed by pressing the weight of the ice bucket on the base 52 of the foot tube 5, which eliminates connection and fixation of the foot tube 5 with the ice bucket body 1 and is more convenient to use.

Embodiment 4

Figure 9:
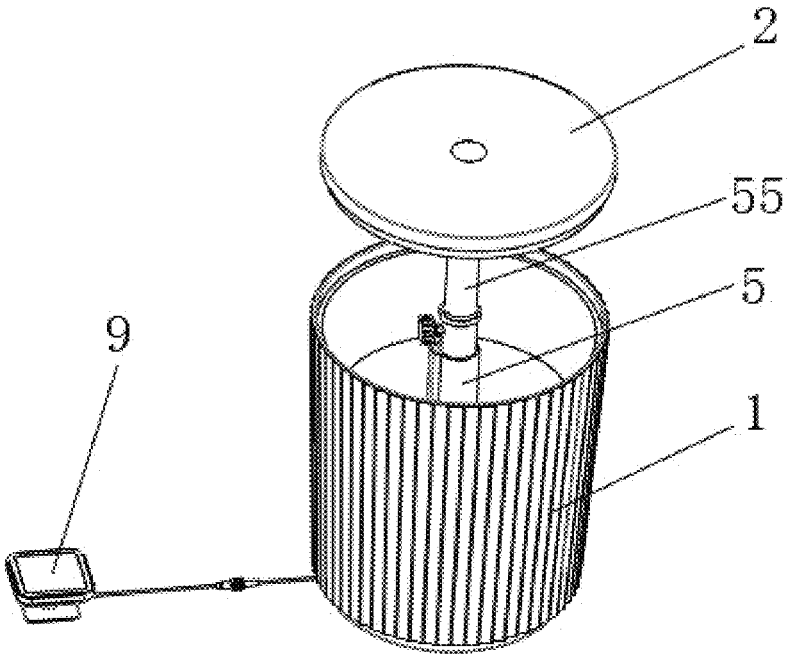
FIG. 9 is a view of the three-dimensional structure of Embodiment 4 of the present application.
Figure 10:
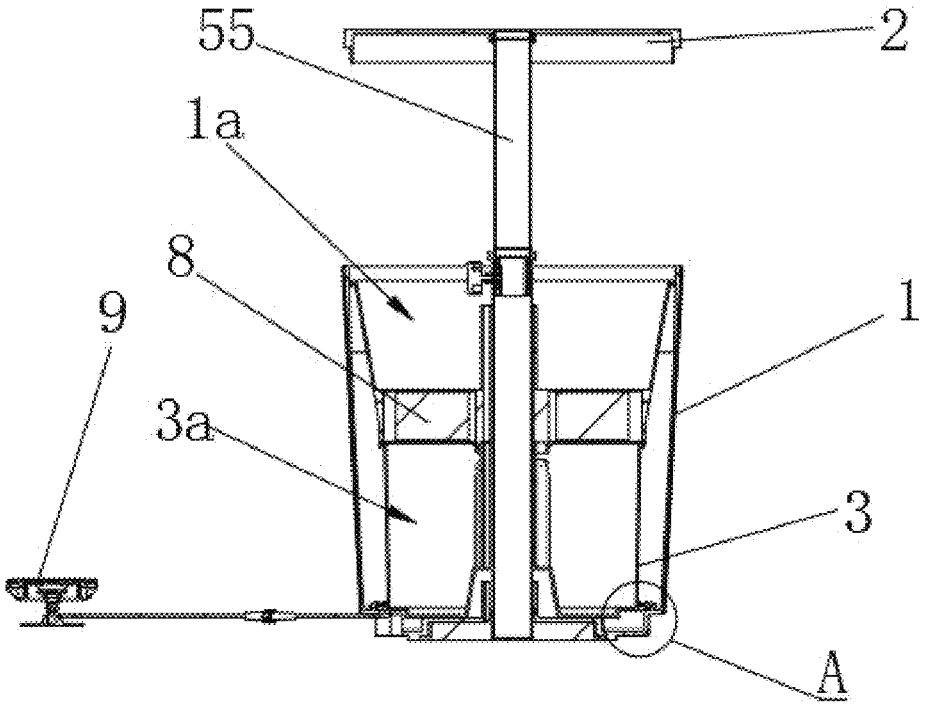
FIG. 10 is a cross-sectional view of Embodiment 4 of the present application.
Figure 11:
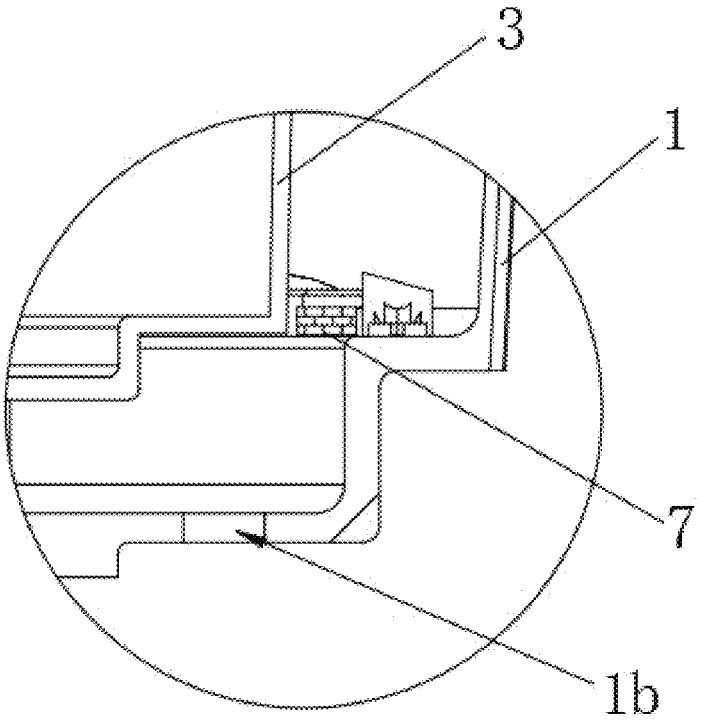
FIG. 11 is an enlarged view of part A in FIG. 10.

As shown in FIGS. 9 to 11, as an extension, the ice bucket structure of this embodiment is based on Embodiment 1, and a waterproof decorative lamp 7 is provided in the ice bucket body 1. The waterproof decorative lamp 7 is preferably a light strip, but lamp beads can also be used. The arrangement of the waterproof decorative lamp 7 can improve the aesthetics of the ice bucket.

In addition, a refrigerator 8 is provided in the ice bucket body 1. Through the refrigeration function of the refrigerator 8, combined with ice cubes in the ice storage cavity 1*a*, the cooling effect of drinks can be enhanced. In this embodiment, the refrigerator 8 is provided above the inner container cover 31, and a partition is provided above the refrigerator 8 to ensure the independence of the ice storage cavity 1*a*.

The refrigerator 8 is detachably connected to a solar module 9 through a direct current (DC) connector. Through the connection of the solar module 9, solar energy can be used for power supply, which is suitable for outdoor use.

In this embodiment, a support tube 55 is inserted into the foot tube 5 (the support tube 55 is not needed when the ice bucket is used as an umbrella base), and then the bucket cover 2 is inserted into the upper end of the support tube 55, so that the bucket cover 2 is in a raised state. In this way, the raised bucket cover 2 is used as a placing surface, users can sit around the ice bucket, and drinks can be placed on the placing surface. At this time, since the bucket cover 2 is raised, the ice storage cavity 1*a* is in an open state, which is convenient for users to take drinks from the ice storage cavity 1*a*. To ensure the integrity of the placing surface, the through hole in the center of the bucket cover 2 can be closed with a plug.

Waterproof decorative lamps 7 and refrigerators 8 can also be provided in the ice bucket structures of Embodiment 2 and Embodiment 3.

Embodiment 5

As shown in FIGS. 12 to 15, the ice bucket structure of this embodiment is similar to that of Embodiment 1, except that in this embodiment, an ice storage box is provided above the inner container 3, an ice storage cavity 1*a* is formed in the ice storage box, and a drain hole with a rubber plug is provided at the bottom of the ice storage box.

Figure 12:
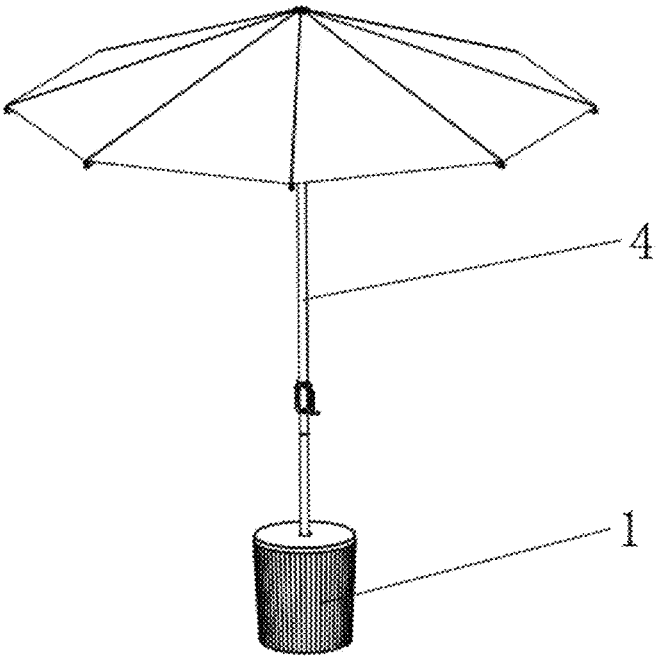
FIG. 12 is a view of the three-dimensional structure of Embodiment 5 of the present application.
Figure 13:
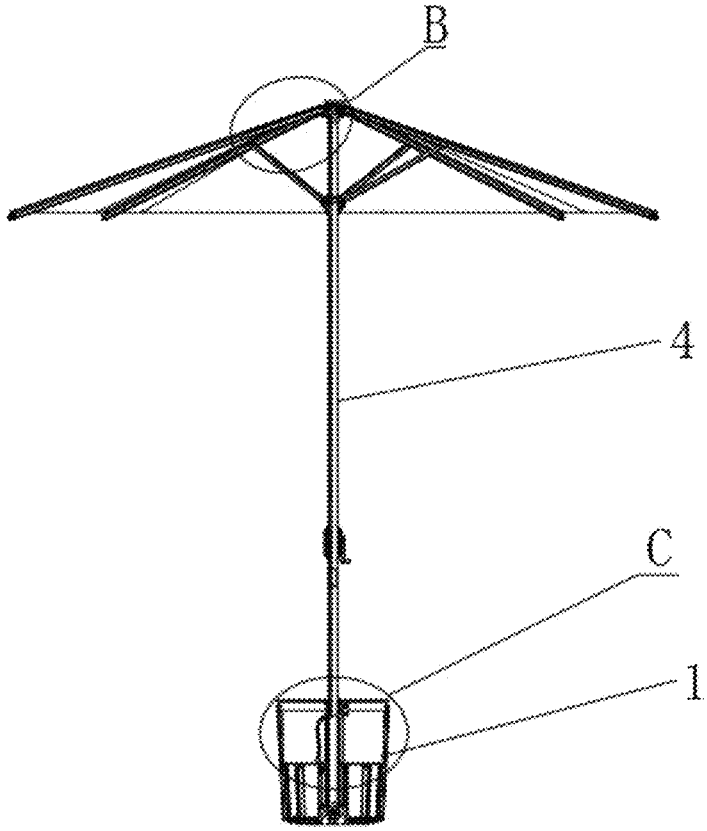
FIG. 13 is a cross-sectional view of Embodiment 5 of the present application.
Figure 14:
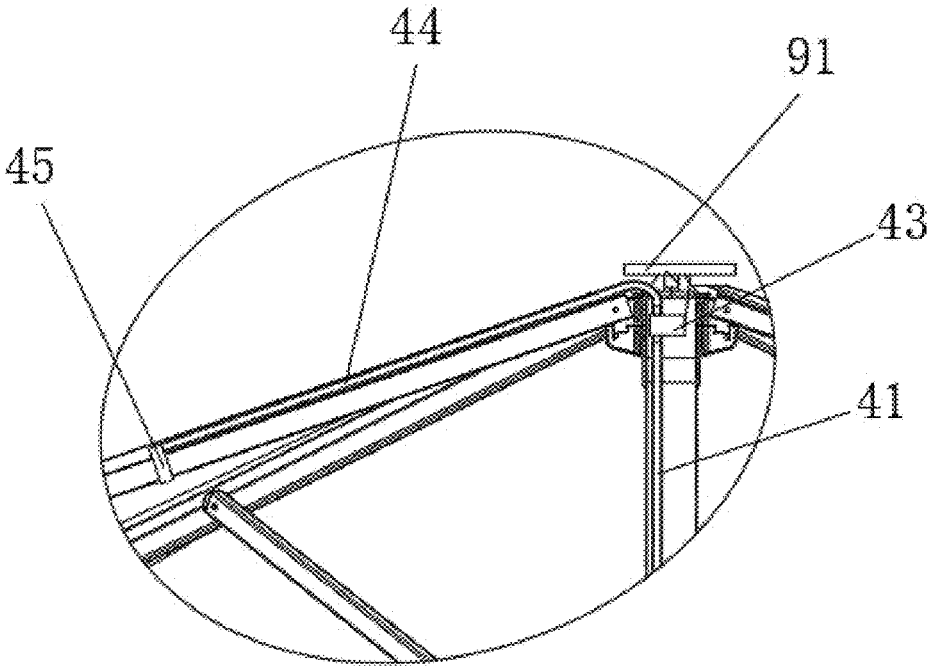
FIG. 14 is an enlarged view of part B in FIG. 13.
Figure 15:
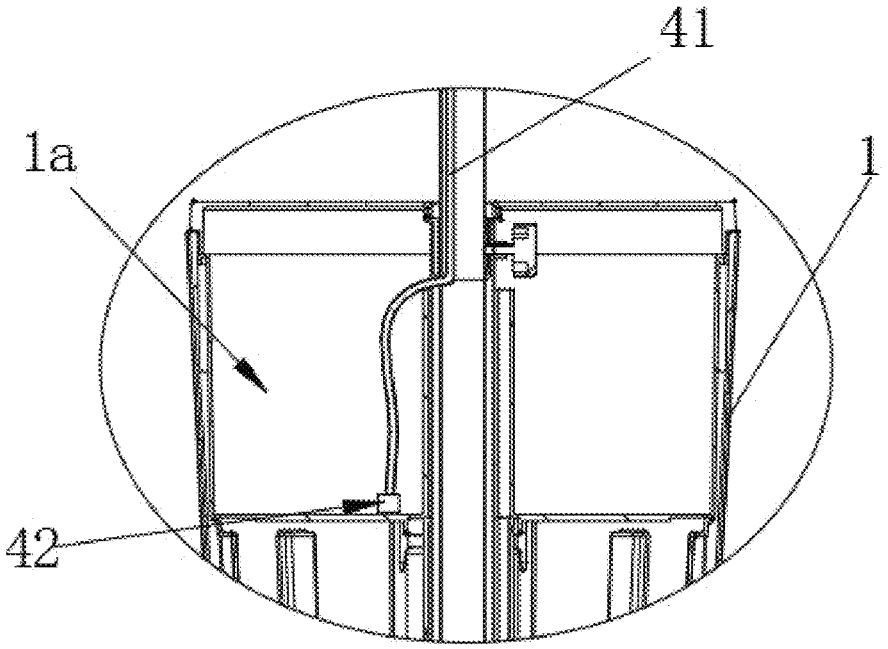
FIG. 15 is an enlarged view of part C in FIG. 13.

When the ice bucket is used as an umbrella base, as shown in FIG. 12, the umbrella pole of the sunshade 4 is inserted and fixed in the foot tube 5. A water suction pipe 41 that can extend into the ice storage cavity 1*a* is provided in the umbrella pole of the sunshade 4, a filter 42 is provided at a lower end of the water suction pipe 41, an upper end of the water suction pipe 41 is connected to a water suction pump 43, a water outlet pipe 44 is connected to the water suction pump 43, and a nozzle 45 is provided at the outlet of the water outlet pipe 44. The water suction pump 43 can be connected with multiple water outlet pipes 44, or multiple branch pipes can be connected from the water outlet pipe 44 through joints, and each water outlet pipe 44 or branch pipe is connected with a nozzle 45. The nozzles 45 can be evenly fixed on the umbrella surface frame.

A solar panel 91 is provided on the sunshade 4, which can use solar energy for power supply. The water suction pipe 41 extends from the top of the sunshade 4 into the ice storage cavity 1*a*.

The water suction pump 43 provides power to suck water from the ice storage cavity 1*a* through the water suction pipe 41, and then the water is atomized by the nozzle 45 and sprayed out, which can play a cooling role (using the ice water after ice melting in the ice storage cavity 1*a*).

Those skilled in the art should understand that the embodiments of the present application shown in the above description and drawings are only examples and do not limit the present application. The purpose of the present application has been completely and effectively achieved. The functions and structural principles of the present application have been shown and explained in the embodiments. Without departing from the principles, the embodiments of the present application can have any deformation or modification.

What is claimed is:

1. An ice bucket structure, comprising an ice bucket body and a bucket cover matching with each other; the ice bucket body being provided with an ice storage cavity;

wherein an inner container is provided in the ice bucket body, a load-bearing cavity is provided in the inner container, and a foot tube for insertion and fixation of a sunshade is vertically provided in the ice bucket body;

wherein a gap is formed between an outer wall of the inner container and an inner wall of the ice bucket body, and a bottom of the ice bucket body is provided with a water leakage hole;

wherein a bushing is provided in the foot tube, and a handwheel bolt is radially provided on the foot tube;

wherein the inner container is provided with an inner container cover that is movable up and down along the foot tube.

2. The ice bucket structure according to claim 1, wherein the foot tube passes through the inner container, and a bottom of the foot tube is fixed to the bottom of the ice bucket body by a fixing screw.

3. The ice bucket structure according to claim 1, wherein the bottom of the ice bucket body is integrally formed with studs, a bottom of the foot tube is provided with a fixing plate, and the fixing plate is provided with fixing holes corresponding to a number of the studs; and the foot tube is inserted from the bottom of the ice bucket body and passes through the inner container, and the studs pass through corresponding fixing holes and are fixed with nuts.

4. The ice bucket structure according to claim 1, wherein a bottom of the foot tube is provided with a base, the foot tube is inserted from the bottom of the ice bucket body and passes through the inner container, and the ice bucket body is placed on the base.

5. An ice bucket structure, comprising an ice bucket body and a bucket cover matching with each other; the ice bucket body being provided with an ice storage cavity;

wherein an inner container is provided in the ice bucket body, a load-bearing cavity is provided in the inner container, and a foot tube for insertion and fixation of a sunshade is vertically provided in the ice bucket body;

wherein a waterproof decorative lamp is provided in the ice bucket body;

wherein a refrigerator is provided in the ice bucket body, and the refrigerator is detachably connected to a solar module through a direct current (DC) connector.

6. The ice bucket structure according to claim 1, wherein a water suction pipe that is extendable into the ice storage cavity is provided in an umbrella pole of the sunshade, a filter is provided at a lower end of the water suction pipe, an upper end of the water suction pipe is connected to a water suction pump, a water outlet pipe is connected to the water suction pump, and a nozzle is provided at an outlet of the water outlet pipe.

7. The ice bucket structure according to claim 5, wherein the foot tube passes through the inner container, and a bottom of the foot tube is fixed to a bottom of the ice bucket body by a fixing screw.

8. The ice bucket structure according to claim 5, wherein a bottom of the ice bucket body is integrally formed with studs, a bottom of the foot tube is provided with a fixing plate, and the fixing plate is provided with fixing holes corresponding to a number of the studs; and the foot tube is inserted from the bottom of the ice bucket body and passes through the inner container, and the studs pass through corresponding fixing holes and are fixed with nuts.

9. The ice bucket structure according to claim 5, wherein a bottom of the foot tube is provided with a base, the foot tube is inserted from a bottom of the ice bucket body and passes through the inner container, and the ice bucket body is placed on the base.

10. The ice bucket structure according to claim 5, wherein a water suction pipe that is extendable into the ice storage cavity is provided in an umbrella pole of the sunshade, a filter is provided at a lower end of the water suction pipe, an upper end of the water suction pipe is connected to a water suction pump, a water outlet pipe is connected to the water suction pump, and a nozzle is provided at an outlet of the water outlet pipe.

* * * * *